United States Patent [19]

Asdollahi

[11] 4,297,666

[45] Oct. 27, 1981

[54] SLOW-BLOWING FUSE USING ZINC-MANGANESE ALLOY LINK

[75] Inventor: Nasrollah Asdollahi, Witten, Fed. Rep. of Germany

[73] Assignee: Wickmann Werke AG, Fed. Rep. of Germany

[21] Appl. No.: 6,779

[22] Filed: Jan. 26, 1979

[30] Foreign Application Priority Data

Feb. 3, 1978 [AT] Austria ..... 757/78

[51] Int. Cl.[3] ..... H01H 85/06

[52] U.S. Cl. ..... 337/163; 337/290; 337/295

[58] Field of Search ..... 337/290, 295, 297, 401, 337/416, 163-166

[56] References Cited

U.S. PATENT DOCUMENTS

| | | | |
|---|---|---|---|
| 3,163,733 | 12/1964 | Ostrofsky et al. | 337/297 |
| 3,845,439 | 10/1974 | Deelman | 337/295 |
| 3,940,728 | 2/1976 | Komatsu et al. | 337/295 |

FOREIGN PATENT DOCUMENTS

| | | | |
|---|---|---|---|
| 1463621 | 3/1969 | Fed. Rep. of Germany | 337/290 |
| 2619329 | 11/1976 | Fed. Rep. of Germany | 337/290 |
| 2623127 | 12/1976 | Fed. Rep. of Germany | 337/290 |

*Primary Examiner*—William H. Beha, Jr.

*Attorney, Agent, or Firm*—Robert E. Burns; Emmanuel J. Lobato; Bruce L. Adams

[57] ABSTRACT

The invention relates to a fuse having a fusible conductor (5) which is wound on a substantially straight carrier body (4). The wire (5) consists of a zinc alloy which contains 0.005% to 2% by weight of manganese.

8 Claims, 2 Drawing Figures

SLOW-BLOWING FUSE USING ZINC-MANGANESE ALLOY LINK

The invention relates generally to fuses and in particular, instrument fuses, having a fusible conductor consisting of a wire wound on an essentially straight carrier body.

In known fuses of this type (see, for example, Austrian Patent Specification No. 324,473) the carrier body consists of insulating fibrous material and an extremely thin silver wire is provided as the fusible conductor, heavily provided with so-called "activator cores".

In the case of another known embodiment (see U.S. Pat. No. 3,845,439) the insulating fibrous material of the straight carrier body has a thin coating for strengthening as well as for improving the characteristics of the fusible cutout, and the carrier body is wound with a thin wire of silver or tin for the conductor.

For use in furnace installations so-called safety fuses of zinc-aluminium alloys in the form of fusible wires are already known (see West German Pat. No. 739,809) and which are used to prevent the occurrence of temperatures which are harmful to the furnace installation itself or to the charge.

Finally, zinc and zinc alloys are found as the conductor material in the case of other known fusible conductors too (see West German Pat. Nos. 876,724 and 1,233,477).

Wires of materials already mentioned above, or of other materials, are converted into fusible conductors both with a relatively large diameter in extended rod-like form, in particular for high normal loadings, and also as specified above in the form of windings of a small wire diameter arranged on carrier bodies for low normal loadings for use, for example, in electrical instruments. On the other hand these other materials exhibit little aptitude for the production of fusible conductors for slow-blowing fuses. For these zinc is preferred, which in comparison, for example, with copper, enables a seven-fold time lag in a fusible conductor of the same wire diameter. In particular because of its high susceptibility to corrosion (see, for example, Swiss Pat. No. 553,478) zinc is on the other hand employed only for fusible conductors of larger diameters in the case of which a corroded surface can be taken into account rather than in the case of thin wire fusible conductors such as are necessary, for example, for instrument fuses.

The problem, therefore, exists of creating a fusible conductor which can be employed in particular for low normal loadings, that is, preferably for apparatus fuses and which is suitable for slow-blowing fuses.

In accordance with the invention a fuse has a fusible conductor comprising a wire wound on a substantially straight carrier body, characterized in that the wire consists of a zinc alloy which contains 0.0005% to 2% by weight of maganese. An alloying addition of 0.03% by weight has proved particularly suitable as prolonged tests at high ambient temperature (40° C.) and high humidity in the air (90%) have shown.

The invention enables the production of fuses which unite in themselves three essential characteristics not heretofore achieveable in this combination. The zinc-manganese alloy imparts to the fusible conductor an adequate corrosion resistance so that even fusible conductors of small cross-sections of zinc wire (where necessary with further alloying additions) may be employed. The zinc-manganese alloy enables in general firstly the processing of zinc into thin-wire fusible conductors having a homogeneous cross-section of constant diameter, that is, of the order of magnitude of 0.05 mm. Finally the known advantages of using zinc as the material for fusible conductors for slow-blowing fusible cutouts are still to be found in the zinc alloy used in the fuse according to the present invention. Since the fusible conductor produced from the zinc alloy can be wound thinly on essentially straight carrier bodies of small cross-section, the fusible conductor is ideal for low normal loadings, that is, in particular for slow-blowing apparatus fuses.

The invention, advantageously, also has an effect upon the possible choice of the material of the carrier body. Glass fiber material can be processed better as the material for the carrier body than a ceramic material which has the advantage of a slighter influence upon the current-time characteristic of the fusible cutout. But the small scope of the glass fiber to influence the heat conductivity can, in the case of a fuse in accordance with the invention, be taken into account since the desired slow-blowing current-time characteristic can be designed in this case essentially on the basis of the form and dimensioning of the fusible conductor winding of zinc alloy.

The pitch of the winding of alloyed zinc wire is advantageously kept symmetrical with respect to the center of the carrier body as well as constant along its length, if the simplest possible manufacture is desired and furthermore if heating of the fusible conductor in its central region is to be greater than at its ends. In order to achieve a uniform effect in respect of concentration and carrying away of heat at the two ends of the winding, the pitch of the winding varies preferably steadily towards the center of the carrier body and in particular is lowest at the center of the carrier body. A concentration of heat in the center of the winding and a particularly slow-blowing fusible conductor is thereby achieved. In the high voltage range it may also be advantageous if the pitch varies unevenly but is constant in sections in order to improve the required extinguishing characteristics because of arcs occurring in series.

One example of a fuse constructed in accordance with the invention will now be described with reference to the accompanying drawings in which.

Figure 1:
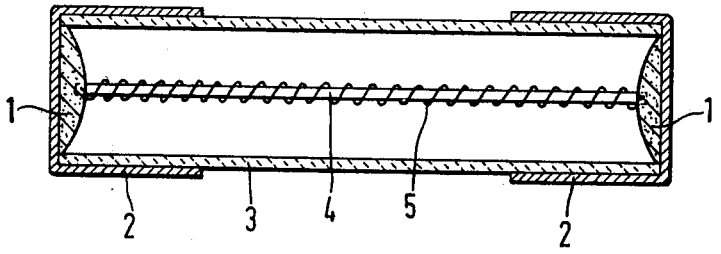
FIG. 1 is a longitudinal section through the fuse.

The fuse shown in FIG. 1 has a fusible conductor 5 soldered by soldering 1 of the usual tin solder to end caps 2 of nickel plated brass, and an insulating body 3 of glass. The carrier body 4 for carrying the conductor 5 consists of glass fiber material and has a length of about 20 mm and a thickness of about 0.2–0.5 mm. As can be seen from the drawing, on the body 4 is wound the fusible conductor 5 which consists of a zinc alloy (0.03% by wt. of manganese) the rest zinc and usual impurities) and has a thickness of 0.05 mm depending upon the pitch of the winding exhibits and a length of two to three times the length of the carrier body 4. This slow-blowing fusible cutout is intended for a normal current of about 100 mA.

Figure 2:
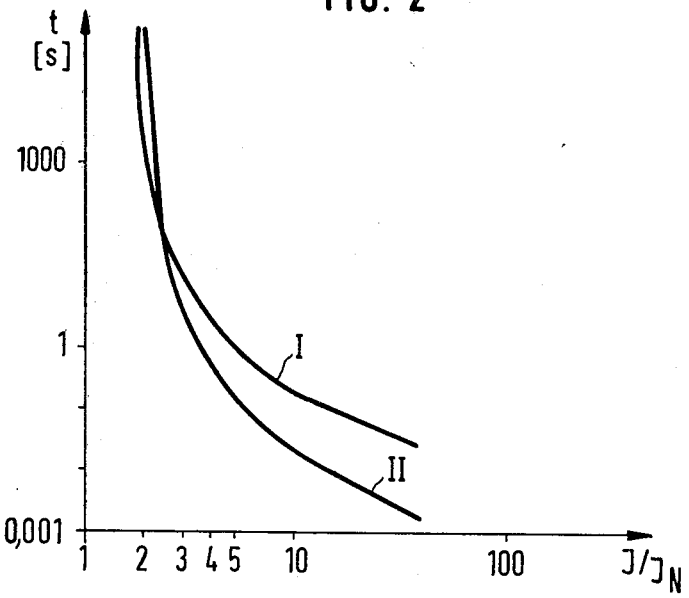
FIG. 2 is a graph showing time-current characteristics.

In the graph of FIG. 2 the curve I shows the time-current characteristic of a slow-blowing fuse substantially in accordance with the example described above and the curve II, in comparison, shows the time-current characteristic of an ordinary slow-blowing fusible cutout with a tin ball as the fusible element. With such fuses a tin bead is fitted at the center of a fusible wire directly connecting the two caps.

The curves I and II make it clear that the time lag of the fuse with a fusible conductor of a zinc-manganese alloy is considerably longer, in the range of a fairly high current loading, and may be more than ten times longer than the tin ball type fuse.

I claim:

1. A slow-blowing fuse having a fusible conductor and a carrier body, said fusible conductor comprising a wire wound on said carrier body and said wire consisting of a zinc-manganese alloy which contains 0.005% to 2% by weight of manganese.

2. A slow-blowing fuse according to claim 1, wherein said zinc-manganese alloy contains 0.03% by weight of manganese.

3. A slow-blowing fuse according to claim 1 or claim 2, in which said wire is wound with a pitch symmetrical with respect to the center of said carrier body.

4. A slow-blowing fuse according to claim 1 or claim 2, in which the wire is wound with a pitch which is constant over the length of said carrier body.

5. A slow-blowing fuse according to claim 1 or claim 2, in which said wire has a homogeneous cross-section of constant diameter which is of the order of magnitude of 0.05 mm.

6. In a slow-blowing fuse of the type having a fusible conductor carried by a carrier body; the improvement wherein said fusible conductor comprises a fusible wire wound about said carrier body, said wire consisting essentially of a zinc-manganese alloy containing from 0.005% to no more than 2% by weight of manganese.

7. A slow-blowing fuse according to claim 6; wherein said wire has a homogeneous cross-section of constant diameter of about 0.05 mm.

8. A slow-blowing fuse according to claims 6 or 7; wherein said manganese is present in an amount of about 0.03% by weight.

* * * * *